US005555973A

United States Patent [19]

Horisawa

[11] Patent Number: 5,555,973

[45] Date of Patent: Sep. 17, 1996

[54] SLIDE SWITCH DEVICE

[75] Inventor: Senji Horisawa, Aichi, Japan

[73] Assignee: Kabushiki Kaisha Tokai Rika Denki Seisakusho, Aichi, Japan

[21] Appl. No.: 222,937

[22] Filed: Apr. 5, 1994

[30] Foreign Application Priority Data

Apr. 7, 1993 [JP] Japan ..... 5-017359 U

[51] Int. Cl.[6] ..... H01H 23/16

[52] U.S. Cl. ..... 200/561; 200/339

[58] Field of Search ..... 200/561, 553, 200/339

[56] References Cited

U.S. PATENT DOCUMENTS

| | | | |
|---|---|---|---|
| 2,936,356 | 5/1960 | Napolin et al. | 200/339 X |
| 3,187,120 | 6/1965 | Akst | 200/561 X |
| 3,339,032 | 8/1967 | Hults | 200/561 X |
| 3,614,346 | 10/1971 | Gudaitis et al. | 200/339 X |
| 3,993,881 | 11/1976 | Marsilio | 200/339 X |

*Primary Examiner*—Renee S. Luebke

*Attorney, Agent, or Firm*—Finnegan, Henderson, Farabow, Garrett & Dunner, L.L.P.

[57] ABSTRACT

A slide switch device including a turnable operating member, a switch body having a movable contact which is slidable along an elongated slide slot, and an arm provided with the operating member rotatable with the turning of the operating member. A motion converting member, which can be "T"-shaped, extending perpendicular to the length of the slide slot is provided for converting rotation of the arm into a slide motion which is transmitted to the movable contact, the motion converting member being pivotally connected to the arm and slidably positioned between the movable contact in the switch body and the arm. The motion converting member may be engaged with the arm through a plurality of pins and with the switch body through a pin extending from the switch body.

4 Claims, 2 Drawing Sheets

SLIDE SWITCH DEVICE

BACKGROUND OF THE INVENTION

1. Field of the invention

This invention relates to a switch of the type that the movable contact of the switch body slides as the operating member is turned.

2. Related Art

For instance, a motor vehicle has a power window mechanism with a switch designed as shown in FIG. 4. The switch has an operating member 3 which is provided on a vehicle body 1 in such a manner that it is turnable around the central axis 2. The operating member 3 has an arm 4 which is protrudes downward. The arm 4 has an engaging groove 4*a* in the end portion, which is engaged with a pin 5*a* embedded in a switch body 5. The pin 5*a* is coupled to a contact holder (not shown) holding a movable contact (not shown). Hence, as the operating member 3 is turned in the direction of the arrow "a", both the pin 5*a* and the movable contact slide along an elongated hole 5*b* as indicated by the two-dot chain line, so that the output signal of the switch body 5 is switched over to another one.

In order to smoothly operate the switch, the operating angle θ through which the operating member 3 is turned to switch the output signal is preferably of the order of fourteen (14) degrees. On the other hand, depending on the specification of the motor vehicle, the switch is large in height, and accordingly the arm is large in length L.

In this case, the slide stroke S of the pin 5*a* of the switch body 5 may be calculated by the following equation:

$$S=L \sin \theta$$

Hence, if the operating angle θ of the operating member 3 is set to 14°, the ideal value, then the slide stroke S of the pin 5*a* is large, so that the movable contact may move past the predetermined point. Thus, in the case where the length L of the arm 4 is large, the operating angle θ of the operating member 3 must be decreased in proportion. In this case, it is impossible to employ the ideal operating angle to switch the output signal which allows the switch to operate most smoothly.

In view of the foregoing, an object of this invention is to provide a switch which is so designed that, even if the switch is large in height, the switch output signal can be achieved with the ideal operating angle which allows the switch to operate most smoothly.

SUMMARY OF THE INVENTION

The foregoing object of the invention has been achieved by the provision of a switch which, according to the invention, comprises: an operating member which is turnable; a switch body having a movable contact which is slidable; an arm provided for said operating member in such a manner that the arm is turned as the operating member turns; and a motion converting member which is slidably provided between the movable contact in the switch body and the arm, the motion converting member converting the rotational motion of the arm into a slide motion which is transmitted to the movable contact.

The switch according to the invention has the motion converting member adapted to convert the rotational motion of the operating member into a slide motion which is transmitted to the movable contact. Hence, even if the height of the switch is increased as much as the motion converting member, the slide stroke of the movable contact, independent of the length of the motion converting member, is determined by the length of the arm and the operating angle of the operating member.

DETAILED DESCRIPTION OF THE PREFERRED EMBODIMENTS

A switch for a power window mechanism in a motor vehicle, which constitutes a first embodiment of this invention, will be described with reference to FIGS. 1 and 2.

Figure 1:
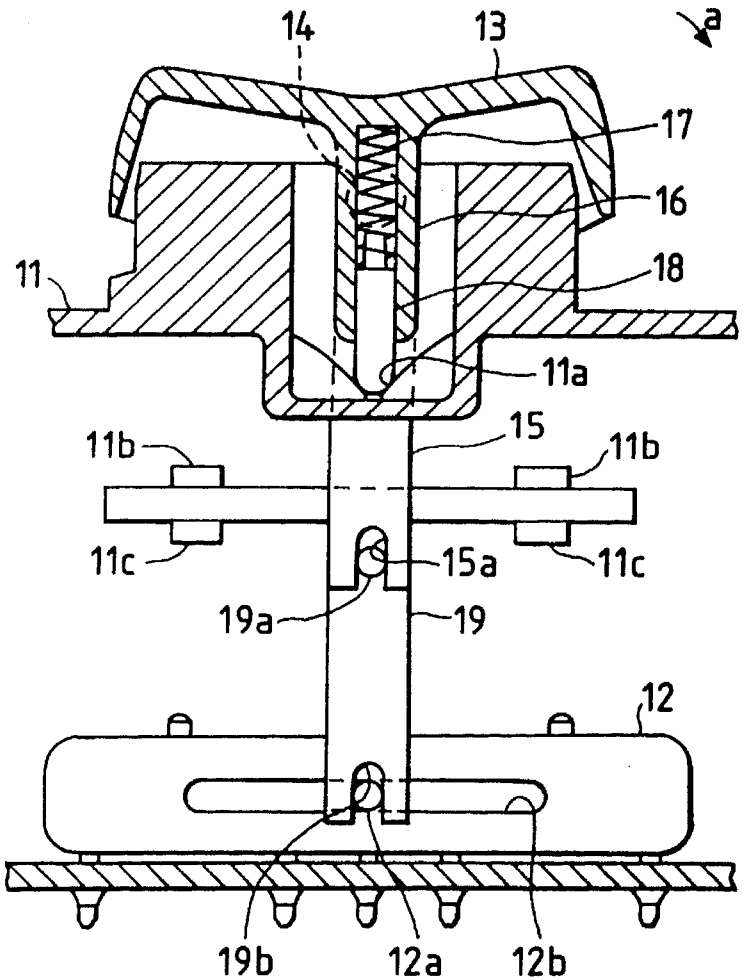
FIG. 1 is a vertical sectional view showing a first embodiment of this invention.
Figure 4:
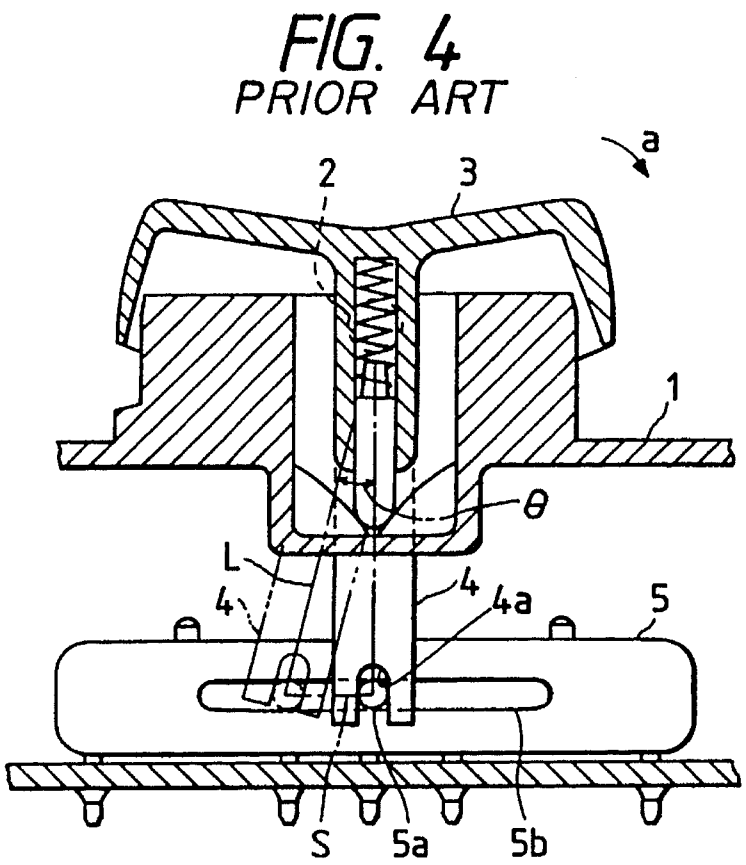
FIG. 4 PRIOR ART
FIG. 4 is a vertical sectional view, corresponding to FIG. 1, showing a conventional switch.

As shown in FIG. 1, a slide type switch body 12 is provided inside a vehicle body 11. A pin 12*a* is protruded from a contact holder (not shown) holding a movable contact (not shown) which is provided inside the switch body 12. More specifically, the pin 12*a* is extended through an elongated hole 12*b* formed in the switch body 12. As the pin 12*a* slides along the elongated hole 12*b*, the movable contact slides to switch the output signal of the switch body 12 over to another one.

An operating member 13 which is turnable about the central axis 14 is mounted on the vehicle body 11. The operating member 13 has an arm 15 which extends downwardly (the length of the arm 15 being equal to that of the conventional arm), and a cylinder 16 in which a spring 17 and a slider 18 are located. The lower end portion of the slider 18 is engaged with a V-shaped recess 11*a* formed in the body 11 by the elastic force of the spring 17. The body 11 is provided with a first pair of guide protrusions 11*b* and 11*c* and a second pair of guide protrusions 11*b* and 11*c*. A T-shaped motion converting member 19 is set between the first pair of guide protrusions 11*b* and 11*c* and between the second pair of the guide protrusions 11*b* and 11*c* in such a manner that the T-shaped motion converting member 19 is horizontally slidable. A pin 19*a* is formed on the upper portion of the T-shaped motion converting member 19, and is engaged with an engaging groove 15*a* formed in the arm 15. The motion converting member 19 has an engaging groove 19*b* in the lower end portion, which is engaged with the pin 12*a* of the switch body 12.

The operation of the switch thus constructed will be described.

As shown in FIG. 1, the lower end portion of the slider 18 is engaged with the recess 11*a* of the body 11, and the operating member 13 is held in the neutral position. When, under this condition, the right end portion of the operating member 13 is pushed, the spring 17 is compressed, so that the slider 18 is retracted being pushed against the sloped surface of the V-shaped recess 11*a*. Thus, the operating member 13 is turned in the direction of the arrow "a".

Figure 2:
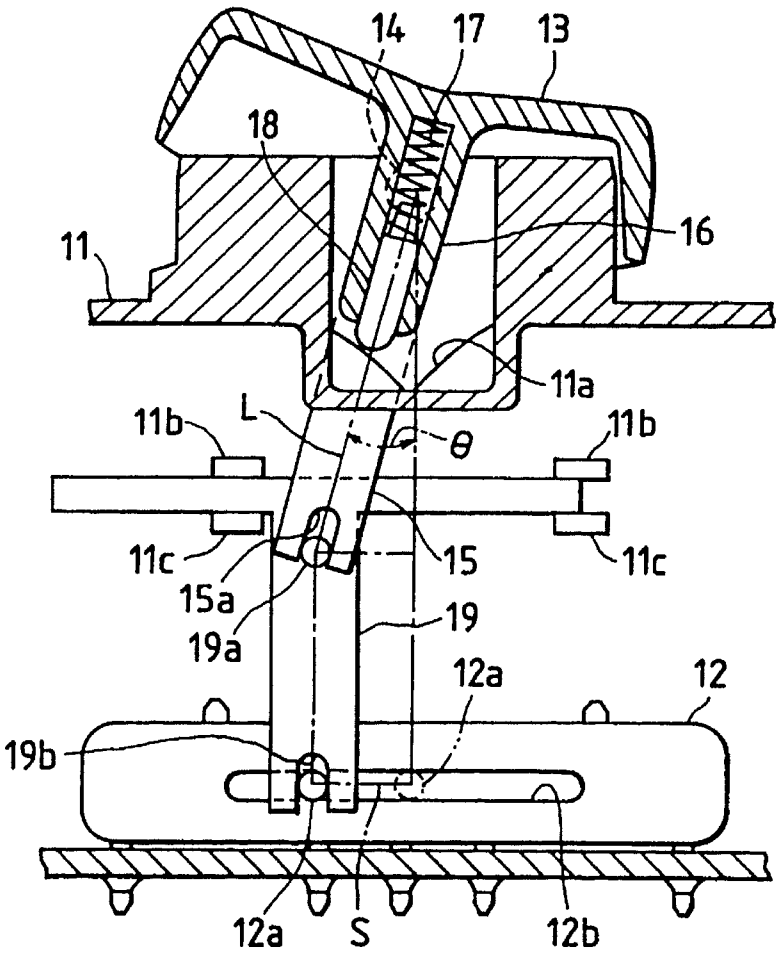
FIG. 2 is a vertical sectional view for a description of the function of a motion converting member in the first embodiment.

As a result, the arm 15 is turned together with the operating member 13 as shown in FIG. 2. The rotational motion of the arm 15 is transmitted to the pin 19*a* of the motion converting member 19, so that the member 19 slides to the left being guided by the guide protrusions 11*b* and 11*c*. The slide motion of the motion converting member 19 is transmitted to the pin 12*a* of the switch body, whereby the pin 12*a* and the movable contact are slid to the left to switch the output signal of the switch body to another one.

When, under this condition, the operating member 13 is released, the spring 17 is elastically restored to cause the slider 18 to protrude along the sloped surface, so that the operating member 13 is returned to the neutral position as shown in FIG. 1. In association with the return of the operating member 13, the arm 15 is also restored; that is, it is held upright, and the motion converting member 19 and the pin 12*a* of the switch body 12 are returned to the neutral position as shown in FIG. 1.

In the above-described first embodiment, as is apparent from FIG. 2, the slide stroke S of the pin 12 of the switch body 12 (i.e., the movable contact) is represented by the following equation:

$$S=L \sin \theta$$

where L is the length of the arm 15, and θ is the operating angle of the operating member 13.

That is, the slide stroke S, independent of the length of the motion converting member 19, is determined by the length L of the arm 15, and the operating angle θ of the operating member 13. Thus, although the height of the switch is increased as much as the length of the motion converting member 19, the output signal of the switch body 12 can be switched over to another one by operating the operating member at the ideal operating angle (for instance 14°) which allows the switch to operate smoothly.

Figure 3:
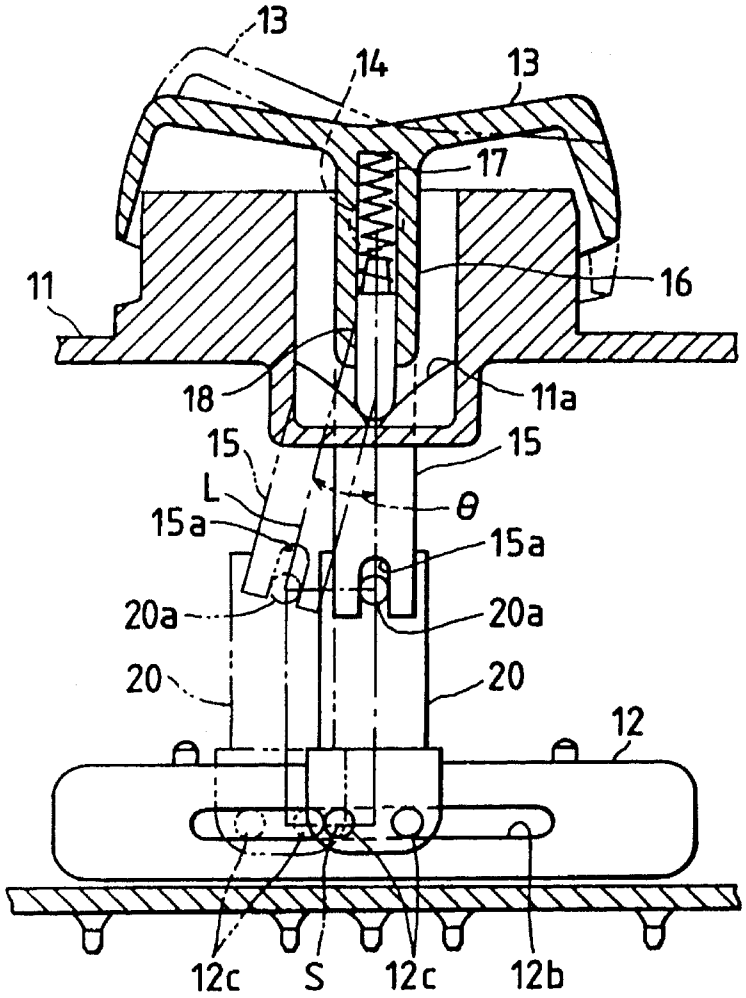
FIG. 3 is a vertical sectional view, corresponding to FIG. 1, showing a second embodiment of the invention.

In the above-described first embodiment, the motion converting member 19 is slid while being guided by the guide protrusions 11*b* and 11*c*; however, the same effect may be obtained by a second embodiment of the invention which is designed as shown in FIG. 3 in which parts corresponding functionally to those which have been described in the first embodiment are designated by the same reference numerals or characters.

In the second embodiment, as shown in FIG. 3, two resin pin 12*c* are extended from a contact holder holding a movable contact in the switch body 12. More specifically, the pins 12*c* are extended outside through an elongated hole 12*b* formed in the switch body 12. The lower end portion of a motion converting member 20 is connected to the contact holder of the switch body 12 by melting and squashing (so-called "heat-caulking") the end portions of the pins 12*c*. A pin 20*a* is formed on the upper portion of the arm 15, which is engaged with the engaging groove 15*a* of the arm 15.

When the right end portion of the operating member 13 is depressed, the arm 15 together with the operating member 13 is turned. The rotational motion of the arm 15 is transmitted through the pin 20*a* to the motion converting member 20. As a result, the pins 12*c* being guided along the elongated hole 12*b* of the switch body 12, the motion converting member 20 is slid to the left with a slide stroke determined by the following equation, so that the output signal of the switch body 12 is switched over to another one.

$$S=L \sin \theta$$

where L is the length of the arm 15, and θ is the operating angle of the operating member 13.

As is apparent from the above description, the switch of the invention includes the motion converting member which is adapted to convert the rotational motion of the operating member into the slide motion which is transmitted to the movable contact of the switch body, so that the slide stroke of the movable contact, independent of the length of the motion converting member, is determined by the length of the arm and the operating angle of the operating member. Hence, although the height of the switch is increased as much as the motion converting member, the output signal of the switch body can be switched over to another one by operating the operating member through the ideal operating angle which allows the operator to operate the switch smoothly.

What is claimed is:

1. A slide switch device comprising:

a turnable operating member having a plane of rotation;

a switch body with a side parallel to said plane of rotation, said switch body side having a closed-ended elongated slide slot and a movable contact slidable along said slot;

an arm provided with the operating member in such a manner than the arm is turned in rotation with the turn of said operating member; and a motion converting member extending perpendicular to the length of the slide slot for converting rotation of the arm into a slide motion which is transmitted to the movable contact, the motion converting member being pivotly connected to the arm and slidably positioned between the movable contact in the switch body and the arm.

2. The slide switch device as claimed in claim 1, wherein the motion converting member is linearly moved with respect to the switch body.

3. The slide switch device of claim 1, wherein:

the motion converting member is T-shaped and is engaged with the arm, and a pair of guide members engage the motion converting member so that it moves linearly.

4. A slide switch device comprising:

a turnable operating member.;

a switch body having a movable contact which is slidable along an elongated slide slot;

an arm provided with the operating member in such a manner that the arm is turned in rotation with the turn of said operating member; and a motion converting member extending perpendicular to the length of the slide slot for converting rotation of the arm into a slide motion which is transmitted to the movable contact, the motion converting member being pivotally connected to the arm and slidably positioned between the movable contact in the switch body and the arm, wherein the motion converting member includes:

one end engaged with the arm through a plurality of pins provided with the motion converting member and the other end of the motion converting member being engaged with the switch body through a pin extending from the switch body.

* * * * *